US011720050B2

(12) United States Patent
Watatani et al.

(10) Patent No.: US 11,720,050 B2
(45) Date of Patent: Aug. 8, 2023

(54) FIXING DEVICE IN WHICH TRANSMISSION PROTRUSION OF FOLLOWER GEAR ABUTS AGAINST ONE OF PROTRUDING PLATE PORTIONS OF HEAT ROLLER MAIN BODY, AND IMAGE FORMING APPARATUS INCLUDING FIXING DEVICE

(71) Applicant: KYOCERA Document Solutions Inc., Osaka (JP)

(72) Inventors: Tomohiro Watatani, Osaka (JP); Yoshiharu Kanematsu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/850,479

(22) Filed: Jun. 27, 2022

(65) Prior Publication Data

US 2023/0004115 A1 Jan. 5, 2023

(30) Foreign Application Priority Data

Jun. 30, 2021 (JP) ..... 2021-109093

(51) Int. Cl.
*G03G 15/20* (2006.01)
*G03G 21/16* (2006.01)

(52) U.S. Cl.
CPC ..... *G03G 21/1647* (2013.01); *G03G 15/2017* (2013.01); *G03G 21/1685* (2013.01); *G03G 2221/1657* (2013.01)

(58) Field of Classification Search
CPC ..... G03G 15/2017; G03G 15/2053; G03G 21/1647; G03G 21/1685; G03G 2221/1657
See application file for complete search history.

(56) References Cited

U.S. PATENT DOCUMENTS 7,127,203 B1 * 10/2006 Pitts ..... G03G 15/2053 399/328
2005/0129433 A1 * 6/2005 Jaskowiak ..... G03G 15/2053 399/330

(Continued)

FOREIGN PATENT DOCUMENTS

JP H0744048 A 2/1995
JP 5902640 B2 * 4/2016

OTHER PUBLICATIONS

Machine Translation of JP5902640 B2 (Tsuchiya; published on Apr. 13, 2016) (Year: 2016).*

*Primary Examiner* — Sophia S Chen
(74) *Attorney, Agent, or Firm* — IP Business Solutions, LLC

(57) ABSTRACT

A heat roller includes a main body and a follower gear. The main body includes a cutaway portion and a pair of protruding plate portions. The follower gear includes a transmission protrusion and an abutment portion. The transmission protrusion is abutted against one protruding plate portion, when the follower gear rotates. The abutment portion is abutted against the one protruding plate portion, when the main body rotates in advance. A size of the transmission protrusion along the width direction of the cutaway portion is smaller than a clearance between the pair of protruding plate portions in the width direction, and a clearance between the abutment portion and the one protruding plate portion in the roller rotation direction is narrower than a clearance between the transmission protrusion and the other protruding plate portion in the roller rotation direction, when the transmission protrusion is in contact with the one protruding plate portion.

4 Claims, 11 Drawing Sheets

(56) References Cited

U.S. PATENT DOCUMENTS

| | | | | |
|---|---|---|---|---|
| 2013/0251418 | A1* | 9/2013 | Ishida | G03G 21/1647 399/328 |
| 2017/0160682 | A1* | 6/2017 | Nishizawa | G03G 15/2053 |
| 2018/0129156 | A1* | 5/2018 | Nemoto | G03G 15/2053 |

* cited by examiner

FIXING DEVICE IN WHICH TRANSMISSION PROTRUSION OF FOLLOWER GEAR ABUTS AGAINST ONE OF PROTRUDING PLATE PORTIONS OF HEAT ROLLER MAIN BODY, AND IMAGE FORMING APPARATUS INCLUDING FIXING DEVICE

INCORPORATION BY REFERENCE

This application claims priority to Japanese Patent Application No. 2021-109093 filed on Jun. 30, 2021, the entire contents of which are incorporated by reference herein.

BACKGROUND

The present disclosure relates to a fixing device, and an image forming apparatus including the fixing device.

Existing image forming apparatuses, such as a laser printer, include an image forming device and a fixing device. The image forming device includes a photoconductor drum, a developing device, a transfer roller, and a light scanning unit (LSU).

The light scanning unit irradiates the photoconductor drum with laser light according to image information, thereby forming an electrostatic latent image on the photoconductor drum. The developing device supplies toner to the photoconductor drum, thereby forming a toner image on the photoconductor drum. The transfer roller transfers the toner image on the photoconductor drum, to a recording sheet. The fixing device fixes the transferred toner image, onto the recording sheet.

The fixing device includes a heat roller, and a pressure roller extending along the heat roller, which are located inside a housing. The heat roller includes a tubular heat roller main body formed of a metal material, and a heater provided inside the heat roller main body. By passing the recording sheet having the toner image formed thereon between the heat roller and the pressure roller, with the heat roller main body being heated by the heater, the toner image is fixed onto the recording sheet.

On an outer circumferential surface of one end portion of the heat roller main body, a follower gear is attached, to rotate the heat roller main body about the axis thereof. The follower gear is meshed with a driver gear.

Normally, a protruding portion is formed on the inner circumferential surface of the follower gear, and a slit-shaped cutaway portion is formed on the end portion of the heat roller main body. The follower gear is attached to the heat roller main body, by inserting the protruding portion of the follower gear in the cutaway portion of the heat roller main body.

SUMMARY

The disclosure proposes further improvement of the foregoing techniques.

In an aspect, the disclosure provides a fixing device including a heat roller and a pressure roller. The heat roller includes a heat roller main body and a follower gear. The heat roller main body is formed in a cylindrical shape. The follower gear is attached to an end portion of the heat roller main body, and meshed with a driver gear. The pressure roller is in pressure contact with the heat roller. The heat roller main body includes a cutaway portion and a pair of protruding plate portions. The cutaway portion is formed in an end portion of the heat roller main body, so as to recede axially inward. The pair of protruding plate portions extend inwardly of the roller, from respective edges of the cutaway portion extending in an axial direction, and are opposed to each other in a width direction of the cutaway portion orthogonal to the axial direction. The follower gear includes a transmission protrusion and an abutment portion. The transmission protrusion is inserted in the cutaway portion, and transmits a rotative motive force of the follower gear to the heat roller main body, by being abutted against one of the pair of protruding plate portions, when the follower gear is made to rotate. The abutment portion is located ahead of the one protruding plate portion of the heat roller main body in a roller rotation direction, and abutted against the one protruding plate portion, when the heat roller main body rotates in advance. A size of the transmission protrusion along the width direction of the cutaway portion is smaller than a clearance between the pair of protruding plate portions in the width direction, and a clearance between the abutment portion and the one protruding plate portion in the roller rotation direction is narrower than a clearance between the transmission protrusion and the other protruding plate portion in the roller rotation direction, when the transmission protrusion is in contact with the one protruding plate portion.

In another aspect, the disclosure provides an image forming apparatus including the foregoing fixing device, and an image forming device. The image forming device forms an image on a recording medium.

DETAILED DESCRIPTION

Hereafter, an embodiment of the disclosure will be described, with reference to the drawings. However, the disclosure is not limited to the embodiment described hereunder.

Embodiment

Figure 1:
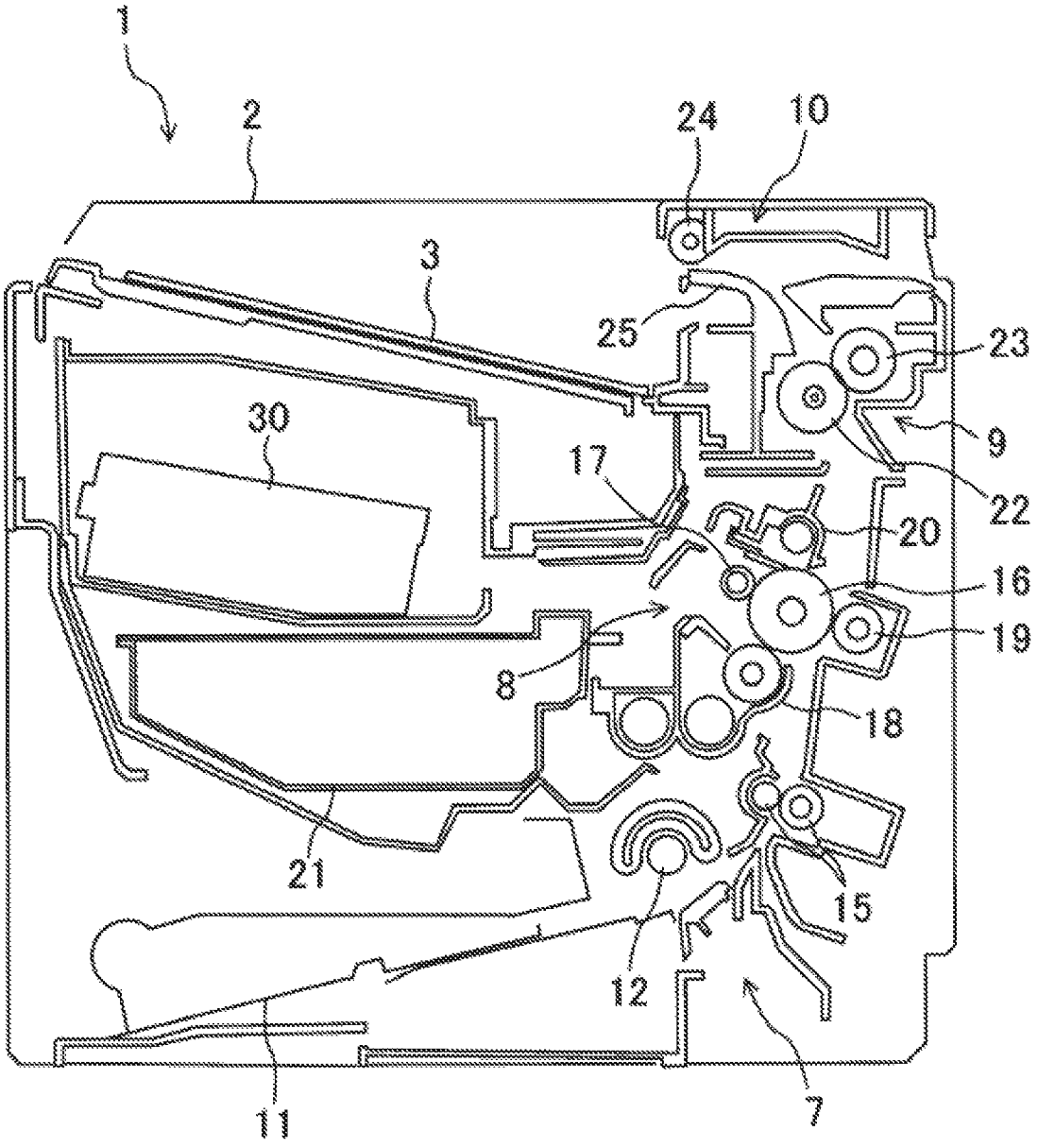
FIG. 1 is a cross-sectional view showing a general configuration of an image forming apparatus.

FIG. 1 is a cross-sectional view showing a general configuration of an image forming apparatus 1 according to the embodiment. As shown in FIG. 1, the image forming apparatus 1 includes a casing 2, a paper feeding device 7, an image forming device 8, a fixing device 9, and a paper delivery device 10. The image forming apparatus 1 is configured to form a toner image on a recording sheet, on a basis of image data transmitted, for example from a terminal device, while transporting the recording sheet along a transport route inside the casing 2.

The paper feeding device 7 is located on a bottom portion of the casing 2. The paper feeding device 7 includes a paper cassette 11 for storing a plurality of recording sheets stacked on each other, and a pickup roller 12 that draws out the recording sheets from the paper cassette 11 one by one.

The image forming device 8 is located inside the casing 2, on the upper side of the paper feeding device 7. The image forming device 8 includes a photoconductor drum 16, serving as an image carrier rotatably installed inside the casing 2, a charging roller 17 located around the photoconductor drum 16, a developing device 18, a transfer roller 19, a cleaning device 20, and a laser scanner unit (LSU) 30 which is a light scanning unit located by the side of the photoconductor drum 16. The image forming device 8 forms an image on the recording sheet, exemplifying the recording medium in the disclosure, delivered from the paper feeding device 7.

The transport route includes a pair of resist rollers 15 that supply the recording sheet delivered from the paper feeding device 7 to the image forming device 8, at a predetermined timing after temporarily detaining the recording sheet.

The fixing device 9 is located inside the casing 2, on the upper side of the image forming device 8. The fixing device 9 includes a heat roller 22 and a pressure roller 23 that rotate in pressure contact with each other. The fixing device 9 serves to fix the toner image formed on the recording sheet by the image forming device 8, onto the recording sheet.

The paper delivery device 10 is located on the upper side of the fixing device 9. The paper delivery device 10 includes an output tray 3, a delivery roller 24 that delivers the recording sheet to the output tray 3, and a transport guide rib 25 that guides the recording sheet to the delivery roller 24. The output tray 3 is formed in a recessed shape in the upper portion of the casing 2.

When the image forming apparatus 1 receives the image data, the photoconductor drum 16 is rotationally driven in the image forming device 8, and the charging roller 17 electrically charges the surface of the photoconductor drum 16.

Then the laser scanner unit 30 irradiates the photoconductor drum 16 with laser light, according to the image data. By the irradiation of the laser light, an electrostatic latent image is formed on the surface of the photoconductor drum 16. A toner container 21 supplies toner to the developing device 18. The electrostatic latent image formed on the photoconductor drum 16 is developed by the developing device 18, into a visible toner image.

The recording sheet passes between the transfer roller 19 and the photoconductor drum 16. While the recording sheet is passing, the toner image on the photoconductor drum 16 is transferred to the recording sheet, by a transfer bias applied to the transfer roller 19. The recording sheet to which the toner image has been transferred is heated by the heat roller 22 under the pressure of the pressure roller 23, in the fixing device 9. As result, the toner image is fixed onto the recording sheet.

Fixing Device

Figure 2:
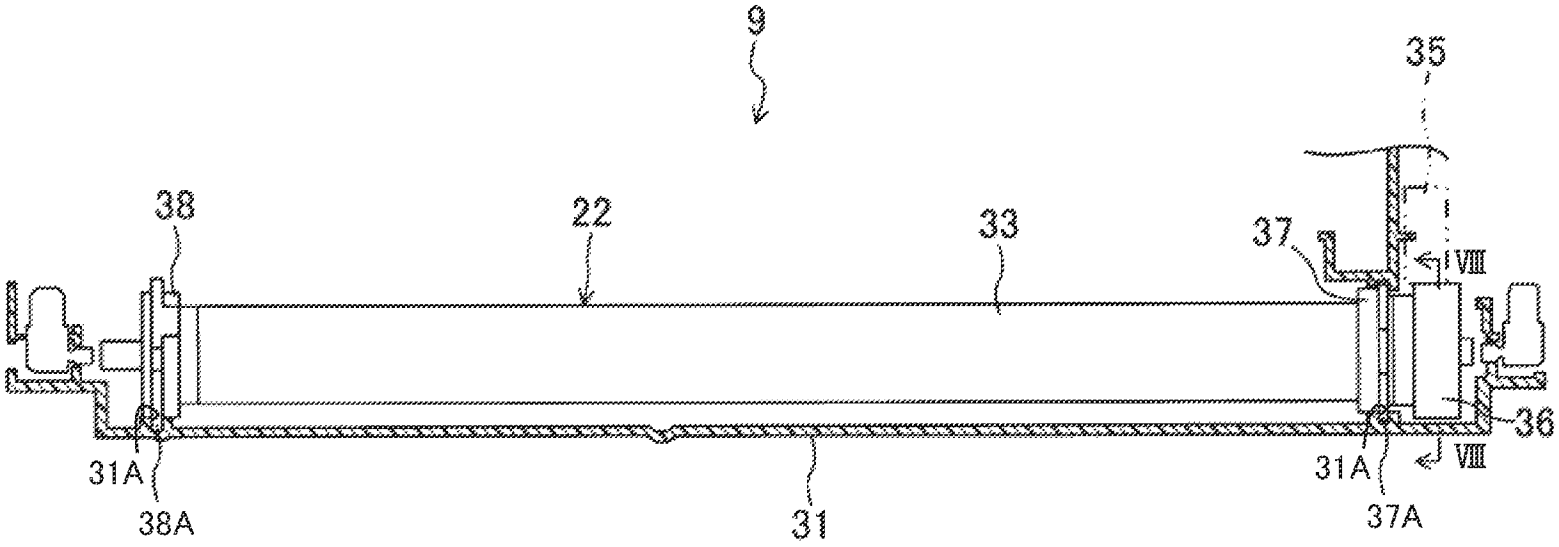
FIG. 2 is a side view showing a fixing device, seen from the side of a heat roller.
Figure 3:
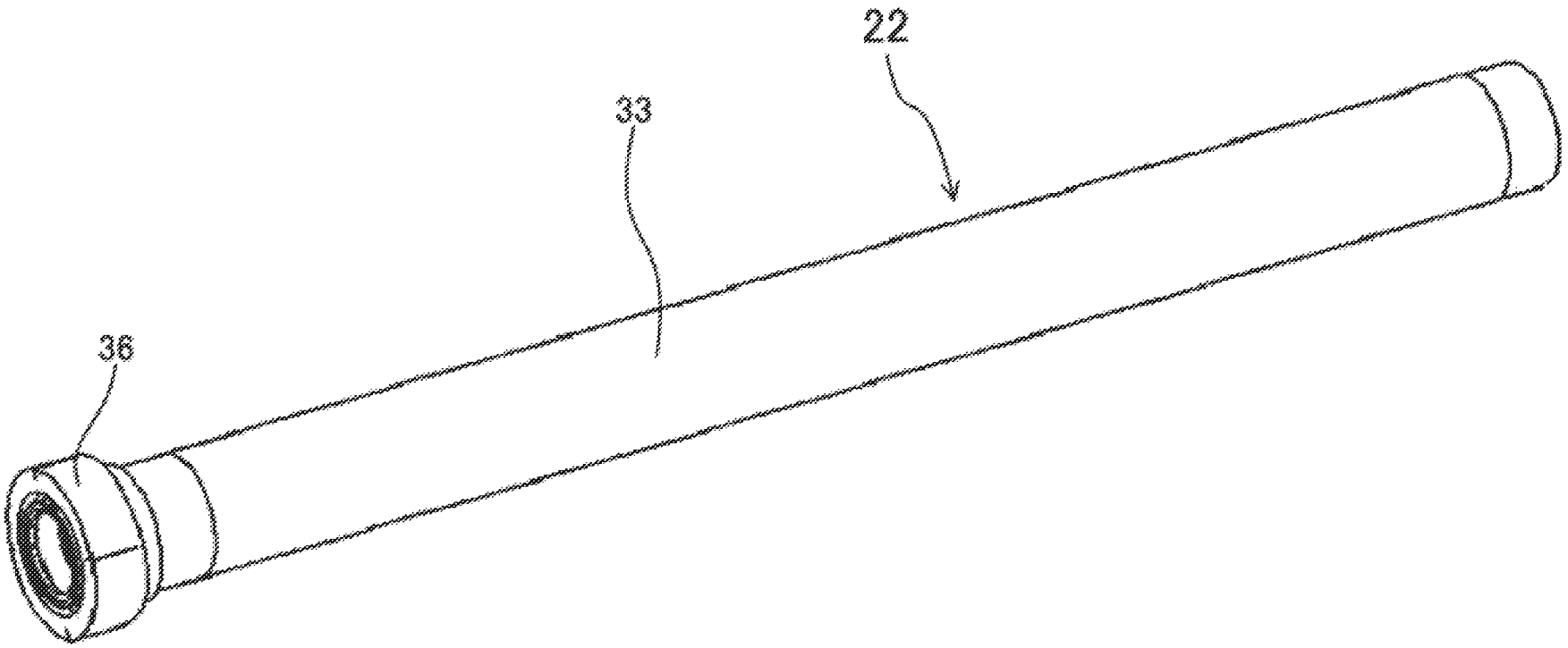
FIG. 3 is a perspective view showing a heat roller main body, with a follower gear attached to an end portion thereof.

FIG. 2 is a side view showing the fixing device 9, seen from the side of the heat roller 22. FIG. 3 is a perspective view showing a heat roller main body 33, with a follower gear 36 attached to an end portion thereof.

As shown in FIG. 2, the fixing device 9 includes a housing 31, and the heat roller 22 rotatably supported by the housing 31. The housing 31 is, for example, formed of a resin material. The fixing device 9 also includes the pressure roller 23 (only shown in FIG. 1) extending along the heat roller 22.

The heat roller 22 includes the heat roller main body 33 formed in a cylindrical shape, a heater 34 serving as the heat source and located inside the heat roller main body 33, and the follower gear 36 attached to the end portion of the heat roller main body 33, and meshed with a driver gear 35.

The heat roller main body 33 is, for example, formed of a metal material such as aluminum, in a circular cylindrical shape. The thickness of the heat roller main body 33 is, for example, equal to or less than 1 mm. The heater 34 is inserted through inside of the heat roller main body 33. The heater 34 is heated by power supply, to heat up the heat roller main body 33 to a predetermined temperature.

The heat roller main body 33 is supported by the housing 31, via bushes 37 and 38, which are cylindrical bearing members. The bushes 37 and 38 are, for example, formed of a resin material.

The bushes 37 and 38 respectively include flange portions 37A and 38A, formed on the outer circumferential surface. The flange portions 37A and 38A are each fitted in a groove 31A formed in the housing 31. Accordingly, the bushes 37 and 38 are restricted from moving axially of the heat roller main body 33.

Figure 4:
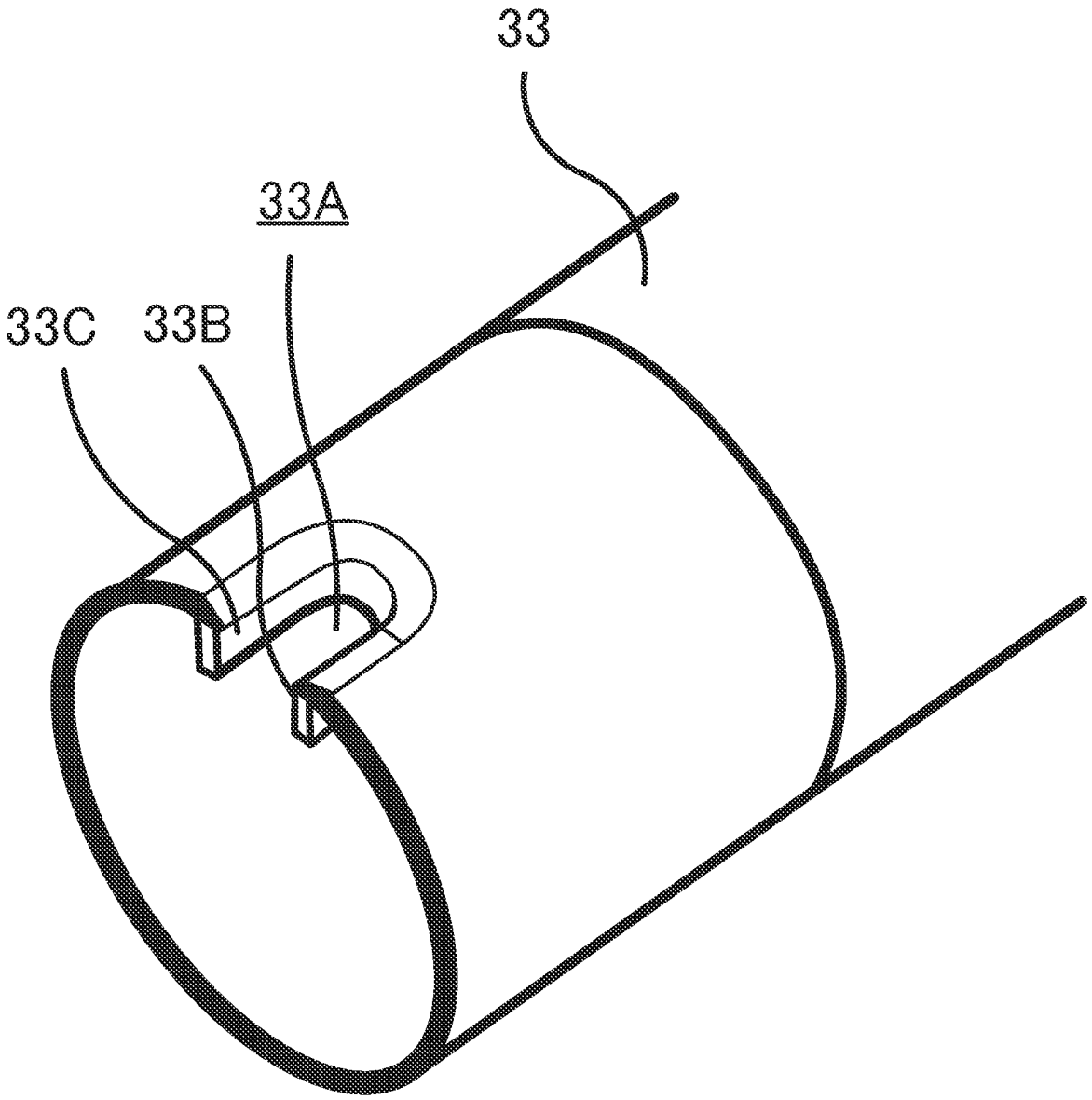
FIG. 4 is an enlarged perspective view showing the end portion of the heat roller main body, to which the follower gear is attached.
Figure 5:
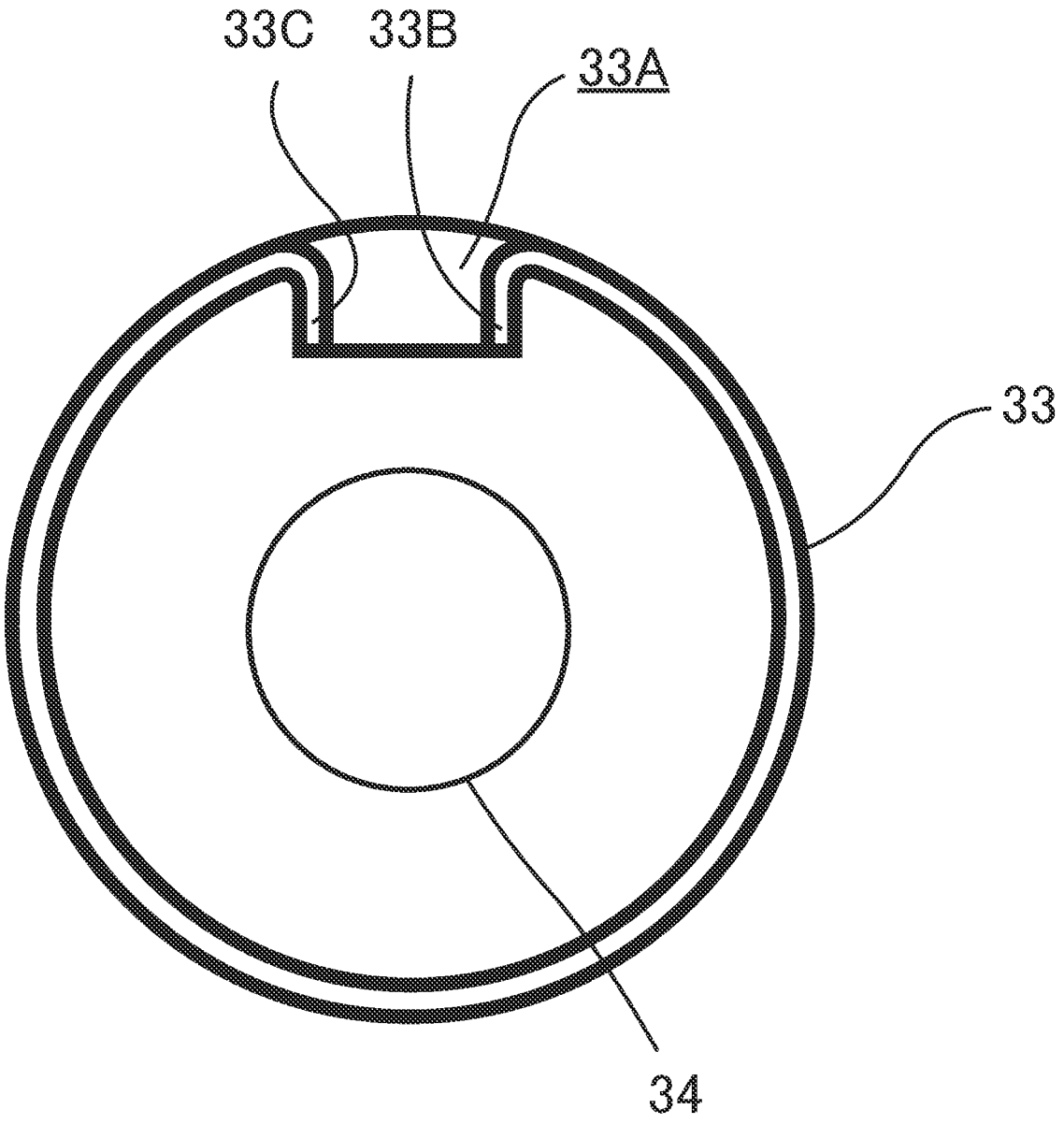
FIG. 5 is a side view showing the end portion of the heat roller main body, to which the follower gear is attached, seen in the axial direction.
Figure 6:
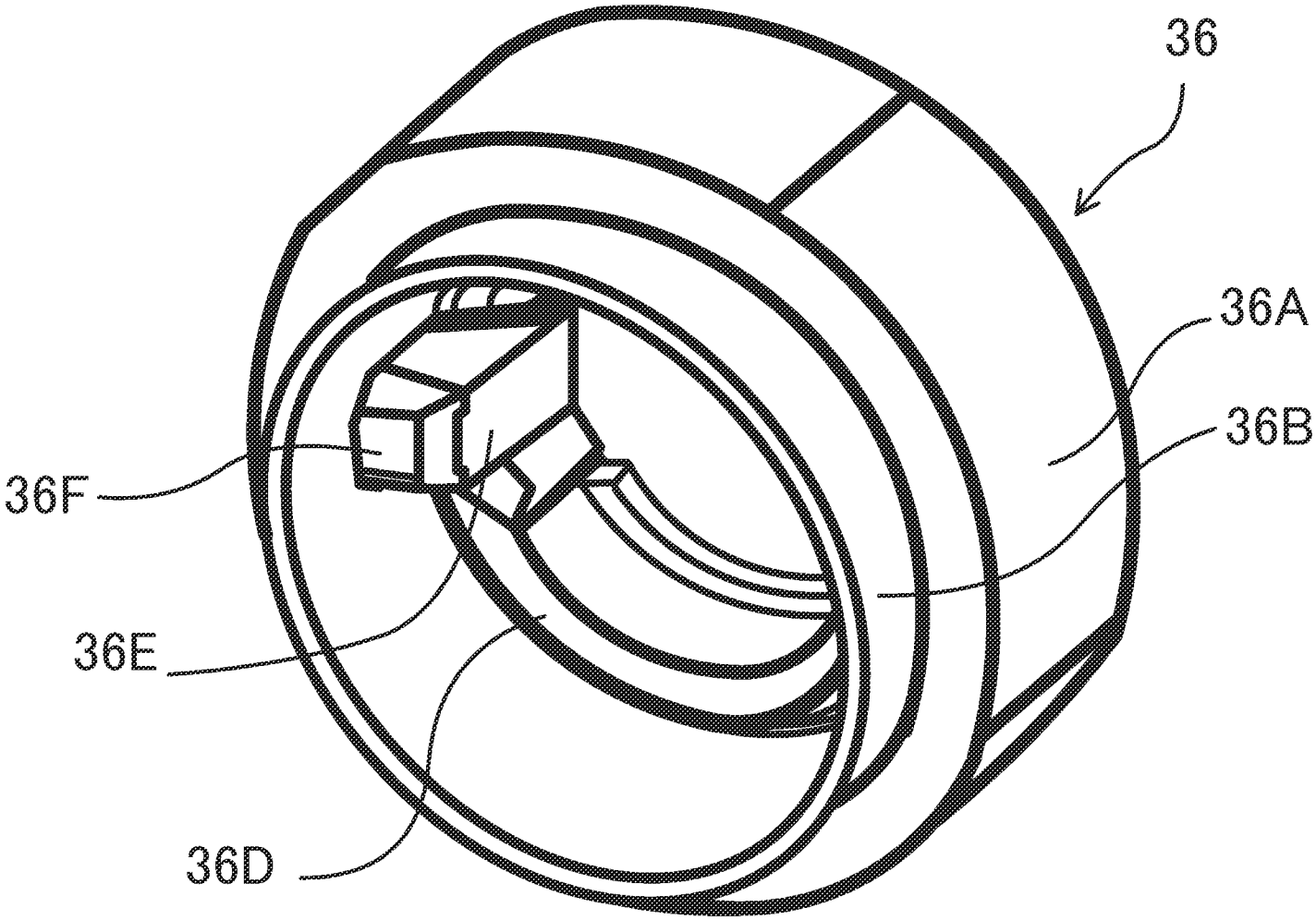
FIG. 6 is a perspective view showing the follower gear.
Figure 7:
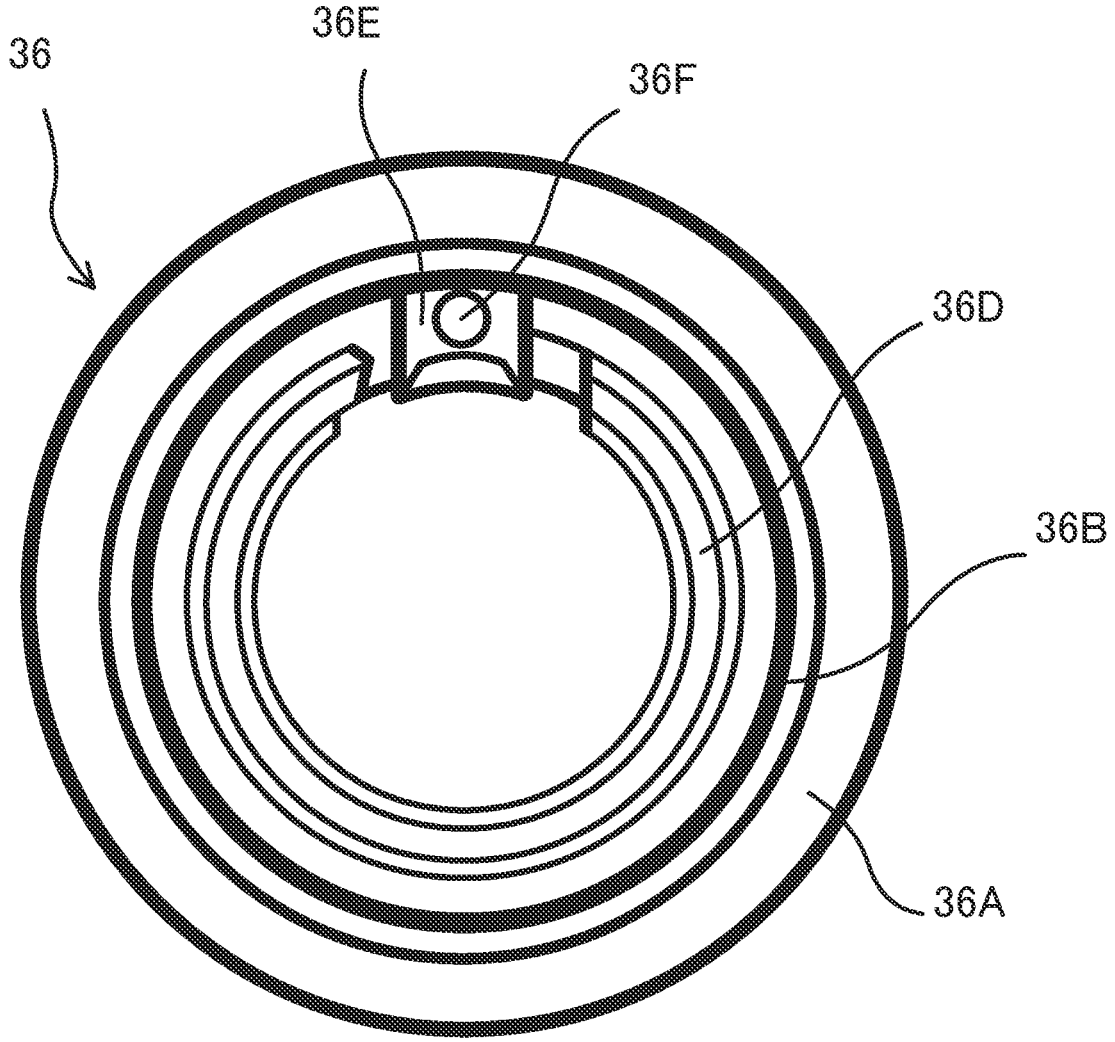
FIG. 7 is a side view showing the follower gear, seen in the side thereof to be inserted.

FIG. 4 is an enlarged perspective view showing the end portion of the heat roller main body 33. FIG. 5 is a side view showing the end portion of the heat roller main body 33, seen in the axial direction. FIG. 6 is a perspective view showing the follower gear 36. FIG. 7 is a side view showing the follower gear 36, seen in the axial direction.

As shown in FIG. 4 and FIG. 5, a cutaway portion 33A is formed at the end portion of the heat roller main body 33. The cutaway portion 33A is formed so as to recede axially inward from the end face of the heat roller main body 33, when viewed in the radial direction thereof.

On the inner peripheral edge of the cutaway portion 33A, U-shaped wall portions are formed so as to protrude inward, radially of the heat roller main body 33. The U-shaped wall portions respectively include a pair of protruding plate portions 33B and 33C, opposed to each other in the width direction of the cutaway portion 33A.

The follower gear 36 includes, as shown in FIG. 7, a transmission protrusion 36E to be inserted in the cutaway portion 33A, when the follower gear 36 is attached to the end portion of the heat roller main body 33. When the protruding plate portion 33B, located ahead of the transmission protrusion 36E in the rotation direction, is pressed by the transmission protrusion 36E, a rotative driving force is transmitted from the follower gear 36 to the heat roller main body 33.

As shown in FIG. 6 and FIG. 7, the follower gear 36 includes a large-diameter cylindrical portion 36A having a gear portion formed on the circumferential surface, and a small-diameter cylindrical portion 36B integrally formed with the large-diameter cylindrical portion 36A, coaxially therewith. The outer circumferential surface of the large-diameter cylindrical portion 36A is meshed with the driver gear 35 (only shown in FIG. 2). The small-diameter cylindrical portion 36B is smaller in outer diameter, than the large-diameter cylindrical portion 36A. A ring-shaped flange portion is formed so as to protrude radially inward, in the proximity of the boundary between the large-diameter cylindrical portion 36A and the small-diameter cylindrical portion 36B of the follower gear 36, so that the end face of the heat roller main body 33 can be abutted against the flange portion. To the inner peripheral edge of the flange portion, a C-shaped rib 36D, having a C-shaped cross-section and extending axially of the roller, is connected.

The C-shaped rib 36D is a columnar portion having a portion in the circumferential direction cut away, so as to form the C-shaped cross section, and serves as a reinforcing rib for the follower gear 36. As will be subsequently described in further detail, the C-shaped rib 36D also serves to prevent an advanced rotation of the heat roller main body 33.

The follower gear 36 includes the transmission protrusion 36E formed on the inner circumferential surface, so as to stride over the large-diameter cylindrical portion 36A and the small-diameter cylindrical portion 36B, and extend in the axial direction. The transmission protrusion 36E is formed so as to penetrate through the cutaway portion of the C-shaped rib 36D, in the axial direction. As shown in FIG. 7, the transmission protrusion 36E protrudes radially inward from the inner circumferential surface of the follower gear 36, and has a generally rectangular shape, when viewed in the axial direction. The transmission protrusion 36E is narrower in width, than the cutaway portion of the C-shaped rib 36D. In addition, the transmission protrusion 36E includes a relief hole 36F, to prevent formation of a sink mark during the molding process.

To attach the follower gear 36 to the end portion of the heat roller main body 33, the transmission protrusion 36E (see FIG. 6) formed on the follower gear 36 is brought to the position of the cutaway portion 33A (see FIG. 4) formed in the heat roller main body 33. Then the follower gear 36 is moved to the inner side from the outer side in the axial direction, with the inner circumferential surface of the follower gear 36 fitted to the outer circumferential surface of the end portion of the heat roller main body 33, until the end face of the heat roller main body 33 is abutted against the flange portion of the follower gear 36. At this point, the attachment is completed.

Figure 8A:
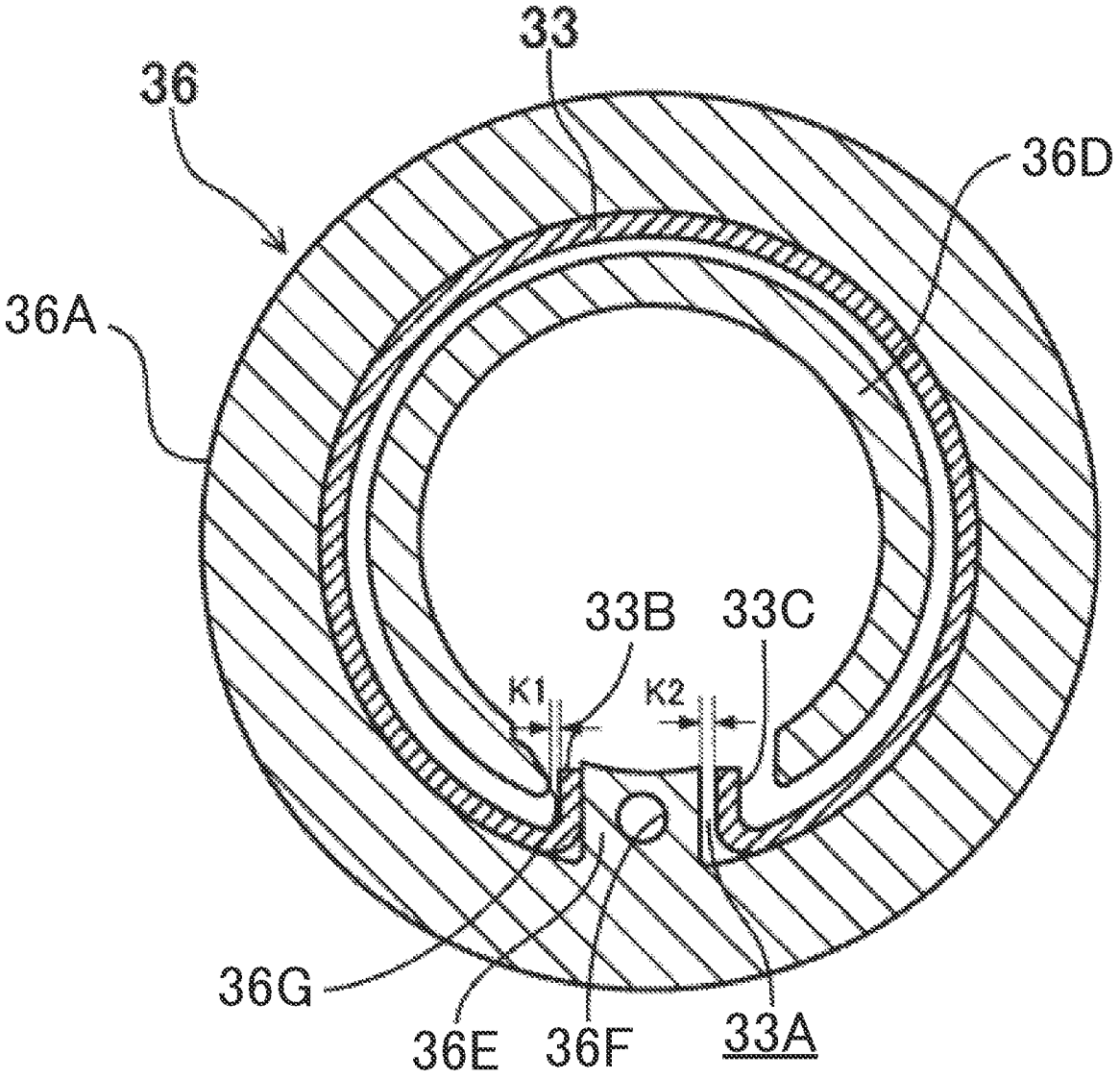
FIG. 8A is a cross-sectional view taken along a line VIII-VIII in FIG. 2, schematically showing the heat roller main body being rotationally driven by the follower gear, without rotating in advance.

FIG. 8A is a cross-sectional view taken orthogonally to the axial direction, showing the state where the follower gear 36 has been attached to the end portion of the heat roller main body 33. When the follower gear 36 is attached, a ring-shaped portion of the end portion of the heat roller main body 33, except the pair of protruding plate portions 33B and 33C, is interposed between the inner circumferential surface of the follower gear 36 and the outer circumferential surface of the C-shaped rib 36D, and the transmission protrusion 36E of the follower gear 36 is inserted between the pair of protruding plate portions 33B and 33C.

When the follower gear 36 is rotationally driven by the driver gear in a predetermined direction (e.g., clockwise in FIG. 8A) about the axial line, the end face of the transmission protrusion 36E on the front side in the rotation direction is abutted against the protruding plate portion 33B. Because of the protruding plate portion 33B being pushed by the transmission protrusion 36E, the heat roller main body 33 rotates in the same direction as the follower gear 36. In this embodiment, an abnormal noise suppression structure is adopted, to prevent generation of an abnormal noise originating from the advanced rotation of the heat roller main body 33, when the follower gear 36 is made to rotate.

To be more detailed, in the abnormal noise suppression structure, as shown in FIG. 8A, a clearance k1 in the roller rotation direction, between the protruding plate portion 33B and an end portion 36G of the C-shaped rib 36D opposed to the protruding plate portion 33B, is narrower than a clearance k2 in the roller rotation direction between the transmission protrusion 36E and the other protruding plate portion 33C, when the transmission protrusion 36E is abutted against the protruding plate portion 33B.

Now, the existing fixing device referred to earlier has such a simple structure that the protruding portion (transmission protrusion) formed on the follower gear is inserted in the cutaway portion formed in the heat roller main body. Accordingly, for example, the end face of the cutaway portion may be knocked forward by the transmission protrusion, which may lead to decline in motive power transmission performance.

To avoid the mentioned drawback, the pair of protruding plate portions may be formed on the heat roller main body, so as to protrude radially inward from the respective edges of the cutaway portion extending in the axial direction, so that the transmission protrusion is abutted against the lateral face of the protruding plate portion, when the follower gear is made to rotate. Such a configuration is expected to improve the motive power transmission performance.

Figure 9A:
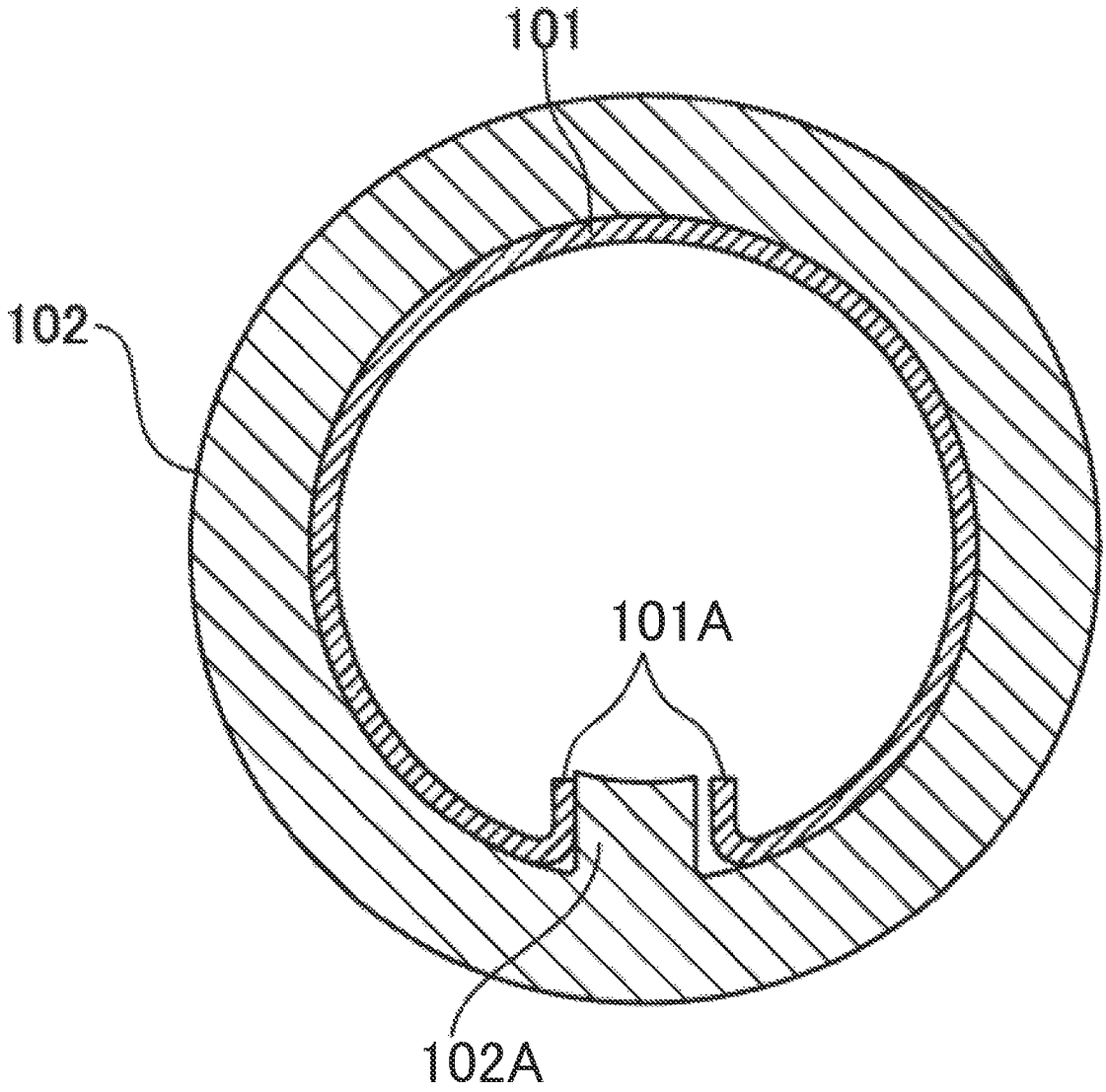
Fig.9A Prior Art
FIG. 9A is a cross-sectional view corresponding to FIG. 8A, showing a conventional example.
Figure 9B:
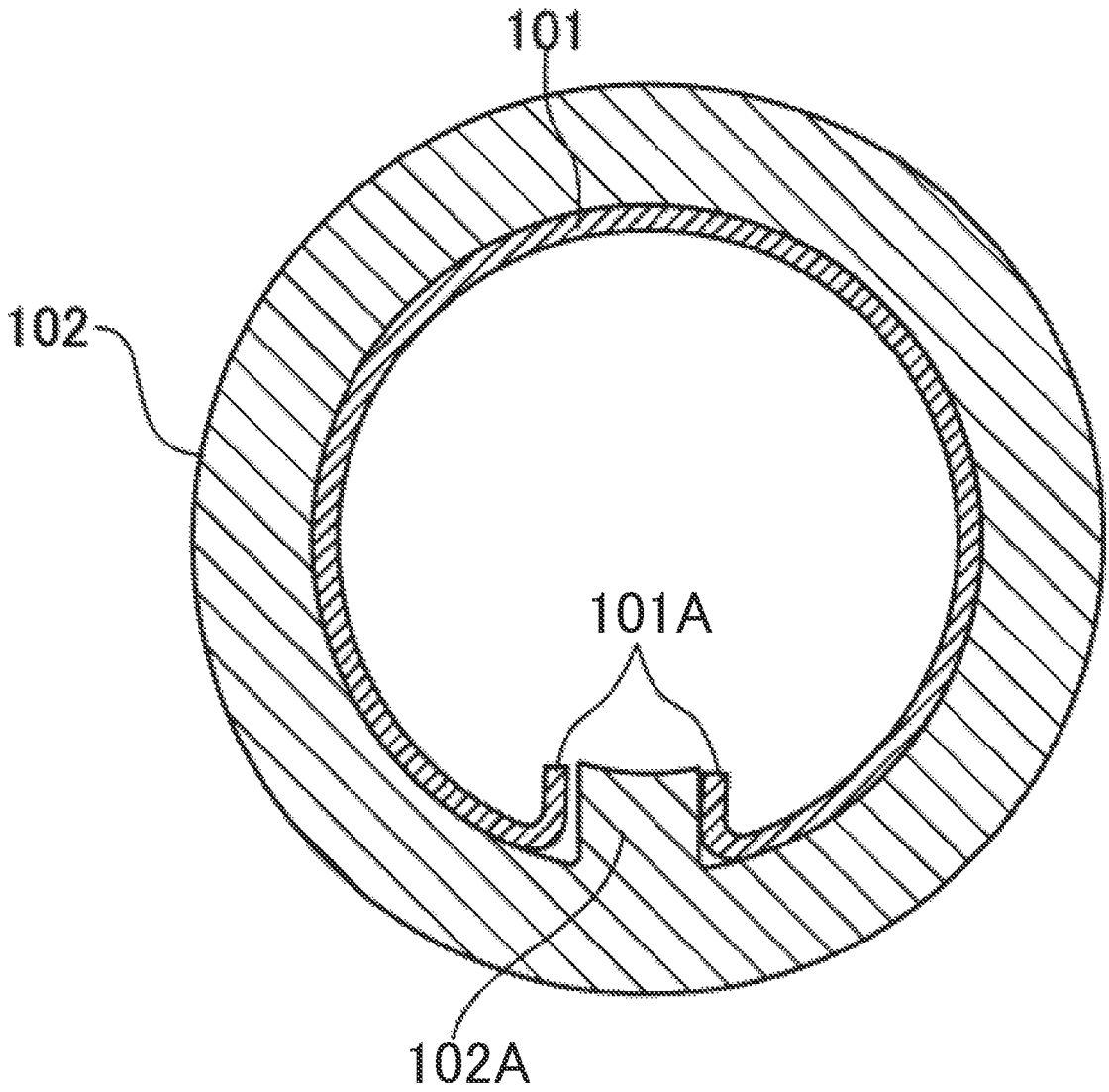
Fig.9B Prior Art
FIG. 9B is a cross-sectional view corresponding to FIG. 8B, showing the conventional example.

FIG. 9A is a cross-sectional view taken orthogonally to the axial direction, showing a follower gear 102 attached to a heat roller main body 101 on which a pair of protruding plate portions 101A are formed. It is preferable to make the clearance between the pair of protruding plate portions 101A wider than the width of a transmission protrusion 102A of the follower gear 102, in consideration of thermal expansion. However, when the follower gear 102 has momentaneously stopped, for example owing to backlash between the follower gear 102 and the driver gear, the heat roller main body 101 rotates in advance, and the protruding plate portion 101A on the front side in the rotation direction collides with the end face of the transmission protrusion 102A, as shown in FIG. 9B. Such collision takes place each time the follower gear stops, and therefore an abnormal noise arising from the collision is periodically generated with the rotation of the follower gear.

Figure 8B:
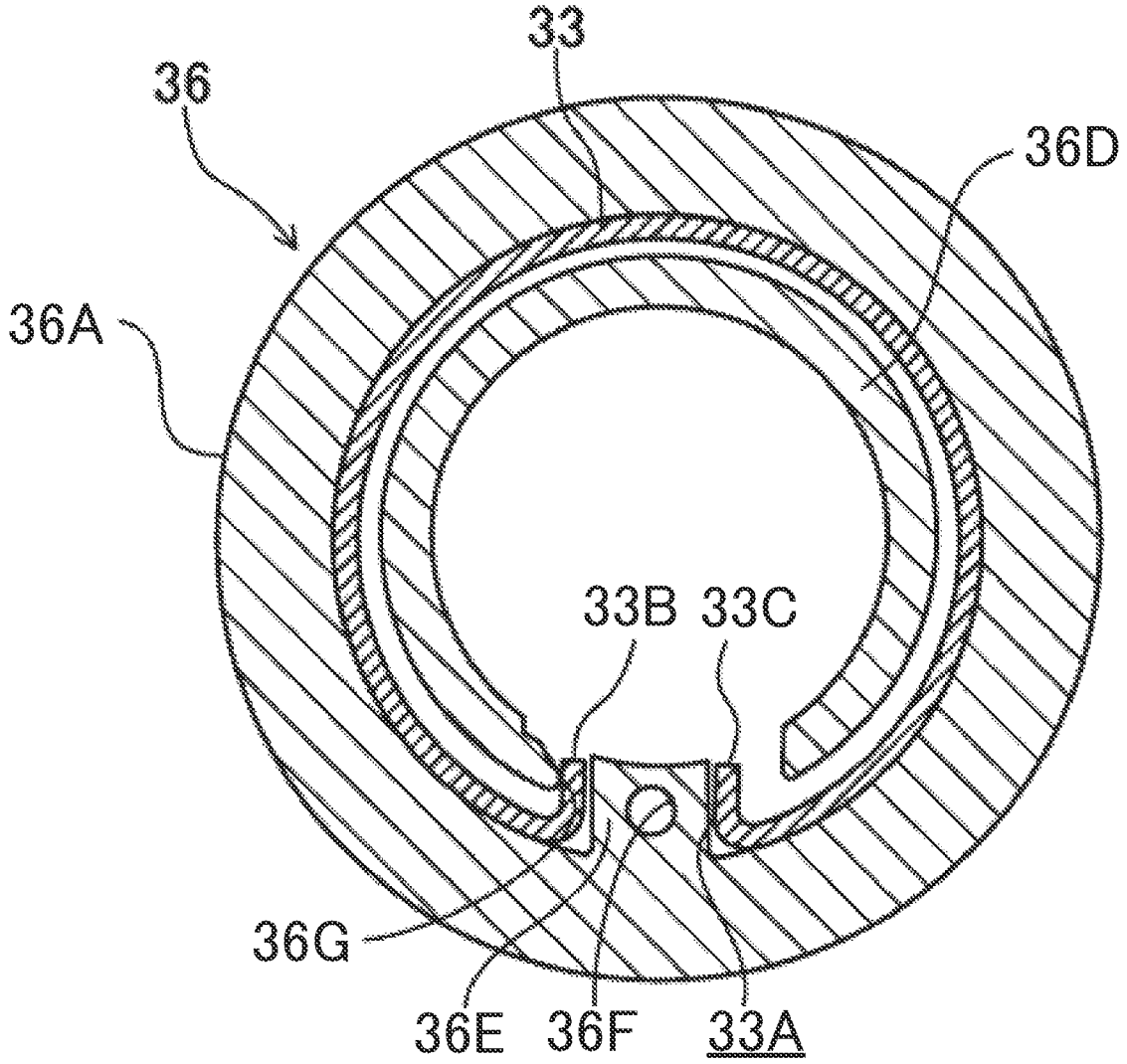
FIG. 8B is a cross-sectional view corresponding to FIG. 8A, showing the heat roller main body rotating in advance.

With the configuration according to the foregoing embodiment, in contrast, even though the heat roller main body 33 rotates in advance, when the follower gear 36 has momentaneously stopped, for example owing to backlash between the follower gear 36 and the driver gear 35 (only shown in FIG. 2), the protruding plate portion 33B is abutted against the end portion of the C-shaped rib 36D, thereby preventing the other protruding plate portion 33C from colliding with the end face of the transmission protrusion 36E, as shown in FIG. 8B. Therefore, generation of the abnormal noise, arising from the collision between the other protruding plate portion 33C and the transmission protrusion 36E, can be suppressed. As result, generation of the abnormal noise originating from the advanced rotation of the heat roller main body 33 can be suppressed, without compromising the motive power transmission performance of the follower gear 36.

Although a slight noise is generated when the protruding plate portion 33B is abutted against the end portion of the C-shaped rib 36D, the clearance k1 between the protruding plate portion 33B and the end portion of the C-shaped rib 36D is narrower than the clearance k2 between the transmission protrusion 36E and the other protruding plate portion 33C, and therefore the collision energy is smaller, and the generated noise is negligibly small. Further, as shown in FIGS. 8A and 8B, the end portion of the C-shaped rib 36D may be formed in a slightly pointed shape, so that the protruding plate portion 33B makes a linear contact or point contact, to reduce the collision noise between the protruding plate portion 33B and the end portion of the C-shaped rib 36D. Forming thus the end portion of the C-shaped rib 36D in the pointed shape reduces the contact area in the case of collision, thereby assuring that the collision noise is suppressed.

Further, the C-shaped rib 36D not only serves to prevent the advanced rotation of the heat roller main body 33, but also serves as a reinforcing rib for the follower gear 36, in the foregoing embodiment. Such a configuration eliminates the need to additionally provide a reinforcing rib, thereby making the follower gear 36 smaller in size and lighter in weight.

Variation

Although the end portion 36G of the C-shaped rib 36D is utilized as the abutment portion in the foregoing embodiment, the disclosure is not limited to such embodiment. For example, a rectangular block of approximately the same size as the transmission protrusion 36E may be provided.

Although the image forming apparatus is exemplified by the printer in the foregoing embodiment, the disclosure is not limited to such embodiment. The disclosure is applicable to other types of image forming apparatuses, such as a copier, a scanner, and a multifunction peripheral.

INDUSTRIAL APPLICABILITY

As described thus far, the disclosure is advantageously applicable to the fixing device, in particular to the fixing device of image forming apparatuses such as a printer, a copier, a scanner, and a multifunction peripheral.

While the present disclosure has been described in detail with reference to the embodiments thereof, it would be apparent to those skilled in the art the various changes and modifications may be made therein within the scope defined by the appended claims.

What is claimed is:

1. A fixing device comprising:

a heat roller including a heat roller main body formed in a cylindrical shape, and a follower gear attached to an end portion of the heat roller main body, and meshed with a driver gear; and a pressure roller located in pressure contact with the heat roller, wherein the heat roller main body includes:

a cutaway portion formed in an end portion of the heat roller main body, so as to recede axially inward; and a pair of protruding plate portions extending inwardly of the roller, from respective edges of the cutaway portion extending in an axial direction, and opposed to each other in a width direction of the cutaway portion orthogonal to the axial direction, the follower gear includes:

a transmission protrusion inserted in the cutaway portion, and configured to transmit a rotative motive force of the follower gear to the heat roller main body, by being abutted against one of the pair of protruding plate portions, when the follower gear is made to rotate; and an abutment portion located ahead of the one of the pair of protruding plate portions of the heat roller main body in a roller rotation direction, and configured to be abutted against the one of the pair of protruding plate portions, when the heat roller main body rotates in advance, a size of the transmission protrusion along the width direction of the cutaway portion is smaller than a clearance between the pair of protruding plate portions in the width direction, and a clearance between the abutment portion and the one of the pair of protruding plate portions in the roller rotation direction is narrower than a clearance between the transmission protrusion and the other of the pair of protruding plate portions in the roller rotation direction, when the transmission protrusion is in contact with the one of the pair of protruding plate portions.

2. The fixing device according to claim 1, wherein the follower gear further includes a C-shaped rib having a cutaway portion at a position corresponding to the transmission protrusion, when viewed in the axial direction of the heat roller main body, and the abutment portion is constituted of an end portion of the C-shaped rib.

3. The fixing device according to claim 2, wherein the end portion of the C-shaped rib is formed in a pointed shape.

4. An image forming apparatus comprising:

the fixing device according to claim 1; and an image forming device that forms an image on a recording medium.

* * * * *